US005480083A

United States Patent [19]

Achelpohl

[11] Patent Number: 5,480,083

[45] Date of Patent: Jan. 2, 1996

[54] DEVICE FOR SEPARATING PERFORATED SECTIONS OF A TUBULAR WEB

[75] Inventor: Fritz Achelpohl, Lienen, Germany

[73] Assignee: Windmöller & Höscher, Lengerich, Germany

[21] Appl. No.: 165,806

[22] Filed: Dec. 13, 1993

[30] Foreign Application Priority Data

Dec. 18, 1992 [DE] Germany ..... 42 43 105.0

[51] Int. Cl.[6] ..... B26F 3/02

[52] U.S. Cl. ..... 225/100; 225/4

[58] Field of Search ..... 225/100, 4, 106; 198/835

[56] References Cited

U.S. PATENT DOCUMENTS

| | | | |
|---|---|---|---|
| 3,140,621 | 7/1964 | Stone | 198/835 X |
| 3,730,411 | 5/1973 | Brockmuller | 225/100 |
| 4,498,894 | 2/1985 | Kuckhermann | 225/100 X |

FOREIGN PATENT DOCUMENTS 4113792 10/1992 Germany .

*Primary Examiner*—Richard K. Seidel
*Assistant Examiner*—Raymond D. Woods
*Attorney, Agent, or Firm*—Keck, Mahin & Cate

[57] ABSTRACT

A device for separating sections of a perforated tubular web includes a pulling mechanism and a tearing mechanism. Each of these mechanisms has opposing rollers positioned facing each other on either side of the tubular section being separated. Continuous conveyor belts run over these rollers. The rollers of the tearing mechanism can be moved by a control element toward the tubular web. To prevent slippage of the web within the pulling mechanism when the tubular sections are being torn, the pulling mechanism is also provided with a control element which moves the rollers or cylinders of the pulling mechanism in a direction perpendicular to the tubular web in order to increase the pressure on the tubular web. The control element of the pulling mechanism is synchronized with a control element of the tearing mechanism.

4 Claims, 1 Drawing Sheet

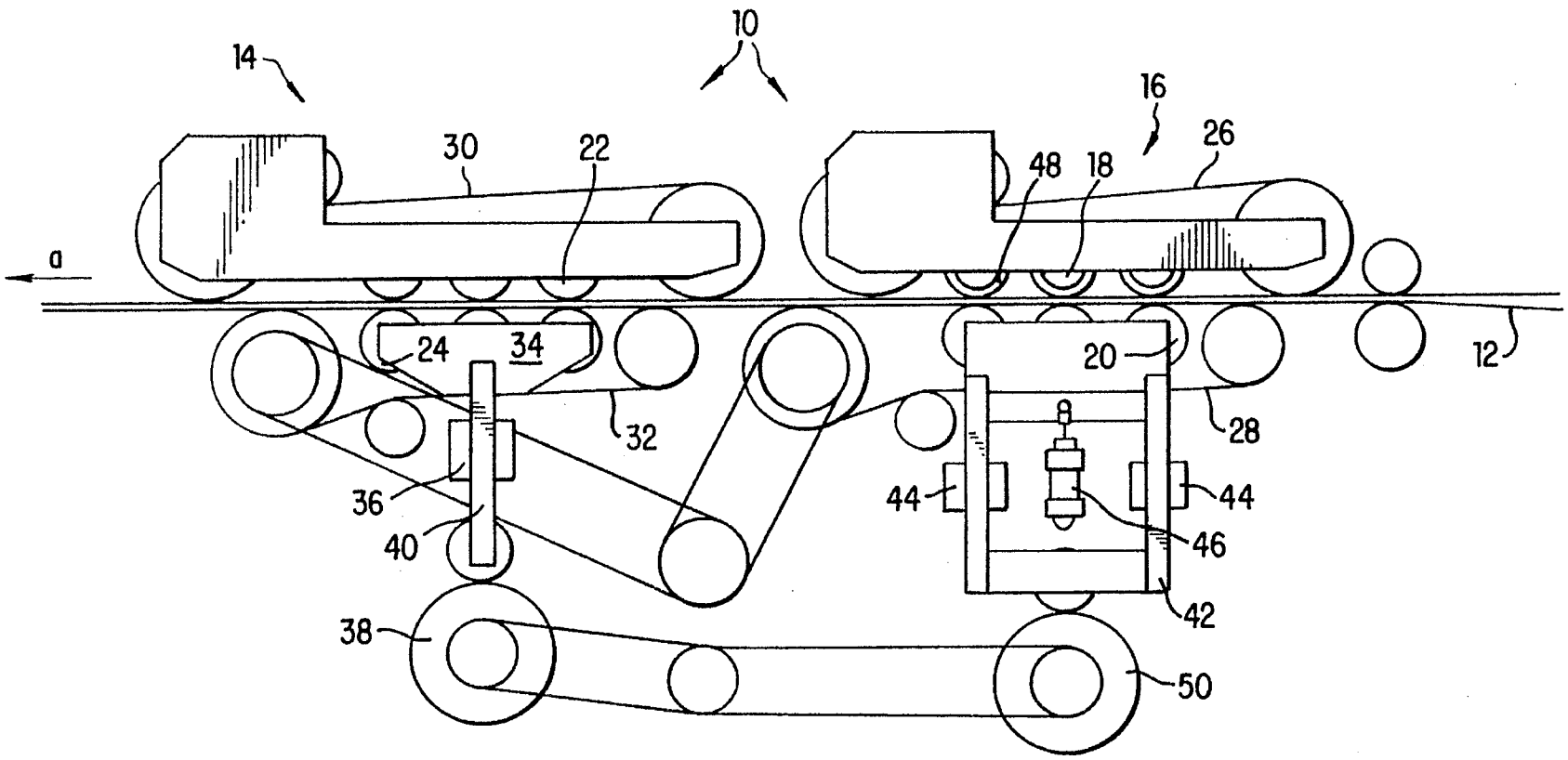
12
28
44
46
42
50
26
16
20
18
48
44
10
32
22
34
30
24
36
40
38
14
a

DEVICE FOR SEPARATING PERFORATED SECTIONS OF A TUBULAR WEB

FIELD OF THE INVENTION

The invention relates to a device for separating sections of a perforated tubular web.

BACKGROUND OF THE INVENTION

This type of separating device is known, for example, from DE 41 3 792 A1. In separating devices of this type, a tubular web is advanced at a certain speed by a pulling mechanism. While the tubular web is being pulled it runs through a tearing mechanism positioned in the direction of travel, without the rollers or cylinders of the tearing mechanism, or the belts guided by them, engaging with the tubular web. If a tubular web is being separated into sections along a perforation running perpendicular to the length of the tubular web, the rollers or cylinders of the tearing mechanism are positioned against the tubular web and are driven at a greater circumferential speed than the rollers or cylinders of the pulling mechanism, to thereby tear off the tubular section. Due to this speed differential, a tractive force is exerted on the entire following portion of the web during tearing. As long as the bridge portions of the perforation have not yet been torn, the tractive force continues into the pulling mechanism. In the known separating devices the facing rollers or cylinders of the pulling mechanism are positioned in staggered fashion. The tubular web thus runs in serpentine fashion between these rollers or cylinders. Practical operation has shown that the pressure exerted on the tubular web by the belts running over the rollers or cylinders is not sufficient to hold the tubular web in position when the tearing mechanism is engaged and, as described above, when the tractive force is exerted on the following portion of the tubular web. This results in undesired slippage, which unfavorably affects the tearing process and may cause strips to form in the tubular web due to the web sliding over the belts.

Summary of the Invention

The purpose of the invention, therefore, is to create a separating device of the type described, in which the tubular web is firmly held in position in the pulling device during the tearing process.

The pulling mechanism accordingly includes a control element by means of which the rollers or cylinders of the pulling mechanism can be moved in a direction perpendicular to the tubular web in order to increase the pressure on the tubular web. In addition, the control element of the pulling mechanism is synchronized with a corresponding control element of the tearing mechanism. Thus when the control element of the tearing mechanism positions the rollers or cylinders against the tubular web, so that a tractive force is exerted on the tubular web due to the differential speed, the control element of the pulling mechanism simultaneously causes the rollers or cylinders to be pressed against each other more intensively, with the result that the tubular web positioned between the rollers or cylinders, or between the belts running on these rollers or cylinders, is securely positioned at the moment the tractive force is first applied.

The control elements of the pulling and tearing mechanisms accordingly may consist of cam wheels which are coupled together.

To provide a proper degree of pressure, a further advantageous embodiment provides that the rotating axes of the facing rollers of the pulling mechanism or the tearing mechanism lie in a plane that is perpendicular to the tubular web.

The pulling mechanism rollers or cylinders that are adjusted by the control element may be mounted in a movable frame which is stressed in the direction of the tubular web. This tension can be produced, for example, by a pneumatic piston-cylinder unit which is held on one side by the movable frame and on the other side by the machine frame.

It is advantageous to apply rubber rings to the circumference of the rollers or cylinders, particularly those of the pulling mechanism. This feature may be advantageously provided for the rollers of the cylinders on one side, so that the contact surface in the area of the facing rollers or cylinders will be enlarged due to the pressure of the facing rollers or cylinders and their penetration into the comparatively soft rubber surface.

BRIEF DESCRIPTION OF THE DRAWING

Further details and advantages of the invention will be explained with respect to the embodiment shown in the drawing. The single FIGURE is a schematic side view of an embodiment of a separating device according to the invention.

DETAILED DESCRIPTION OF THE PREFERRED EMBODIMENTS

A device 10 for separating tubular sections from a perforated tubular web 12 consists of a tearing mechanism 14 and a pulling mechanism 16. The FIGURE shows that the tearing mechanism 14 is positioned in the direction of conveyance (shown by arrow "a") with respect to the pulling mechanism 16.

The pulling mechanism 16 and the tearing mechanism 14 each have rollers or cylinders 18, 20 and 22, 24 positioned on either side of the tubular web 12 and over which belts 26, 28 and 30, 32 run. The belts are driven in a known manner.

The rotating axes of the facing rollers or cylinders 18 and 20 or 22 and 24 lie in a plane that runs perpendicular to the tubular web. Thus, the tubular web 12 is pressed along a contact line between the rollers or cylinders. The pressure is equalized by the circulating belts 26, 28 and 30, 32.

While the rollers or cylinders 18 and 20, or the belts 26 and 28 of the pulling mechanism 16 which run around these rollers, are always in contact with the tubular web, the rollers or cylinders 22 and 24, or the belts 30 and 32 of the tearing mechanism 14 which run around these rollers, only come into contact with the tubular web when a tubular section is to be torn. Otherwise, there is an air gap of about 1 mm between the circumference of the rollers or cylinders 22 and 24, or the belts 30 and 32 running around these rollers, and the surface of the tubular web 12. When the tearing mechanism 14 is activated, the rollers 24, which are positioned beneath the tubular web 12 and are mounted in a frame 34, are pressed against the tubular web 12 in such a way that the web is clamped between the upper rollers 22 and the lower rollers 24, or between the belts 30 and 32 running on these rollers, and the web is pulled away at a speed that differs from the advancing speed. The rollers or cylinders 24 are brought into position and the frame 34, which is movably mounted in a guide element 36, is moved by means of a cam wheel 38 at a right angle to the direction of advance "a" of the tubular web 12.

The rollers or cylinders 20 of the pulling mechanism are mounted in a frame 42. Frame 42 is mounted in guides 44 such that the frame can be moved in a direction perpendicular to the tubular web 12. A pneumatic piston-cylinder unit is attached to a point on the frame and is mounted at its other, free end to the machine frame. The piston-cylinder unit presses the rollers or cylinders 20 against the rollers or cylinders 18 with a predetermined pressure.

The rollers or cylinders 18 of the pulling mechanism which face the rollers or cylinders 20 include rubber rings 48 over their circumferences. The contact pressure presses the rollers or cylinders 20 and the circulating belt 28, as well as the tubular web 12 and the circulating belt 26, into the circumferential rubber rings 48 of the rollers 18. This guarantees a satisfactory degree of contact.

When the rollers or cylinders 24 are brought into contact with the tubular web 12 by cam wheel 38, the frame 42 is also moved in a perpendicular direction and brought into contact with the tubular web 12 by a cam wheel 50, so that the rollers or cylinders 20 are pressed against the web 12 at an increased pressure. This provides a good grip on the tubular web 12 when a tractive force is introduced to the web 12 by the tearing mechanism 14. After the tubular section is torn off, the pressure of the rollers or cylinders 20 is again reduced by means of the control function exercised by the cam wheel 50. This is important, since adhesive transverse strips might otherwise be damaged due to excessive pressure in the pulling mechanism. To prevent such undue pressure on adhesive transverse strips in the pulling mechanism, the pneumatic piston-cylinder unit 46 may be controlled in such a way that the pressure of the rollers of cylinders is decreased when an adhesive transverse seam passes through the mechanism.

While the invention has been described above with respect to certain embodiments thereof, it will be apparent to one skilled in the art that variations and modifications may be made without departing from the spirit and scope of the invention.

What is claimed is:

1. A device for separating sections of a perforated tubular web, comprising a pulling mechanism and a tearing mechanism, each said mechanism comprising horizontal rollers on each of opposite sides of a perforated tubular section to be separated from the web and continuous conveyor belts running over the rollers on each of the opposite sides of each said mechanism, the rollers of one of the sides of the tearing mechanism being movable toward the tubular web using a control element, the pulling mechanism further comprising a control element for moving the rollers of one of the sides of the pulling mechanism in a direction perpendicular to the tubular web for increasing pressure on the tubular web in said direction perpendicular to the tubular web, the control element of the pulling mechanism being synchronized with the control element of the tearing mechanism, wherein rotational axes of opposing rollers of at least one of at least one of the pulling mechanism and the tearing mechanism are disposed vertically above one another and wherein rubber rings are provided around a circumference of at least some of the rollers of the at least one mechanism.

2. A device according to claim 1, wherein the control elements of the pulling and tearing mechanisms comprise cam wheels that are coupled together.

3. A device according to claim 1, wherein the rollers of the pulling mechanism which are moved by the control element of the pulling mechanism are mounted in a movable frame which is stressed in a direction of the tubular web.

4. A device according to claim 3, wherein the stress is produced by a pneumatic piston-roller unit connected on a first side to the movable frame and on a second side to a machine frame.

* * * * *